United States Patent [19]

Huang

[11] Patent Number: 4,750,095

[45] Date of Patent: Jun. 7, 1988

[54] AUTO-LIGHTING FLASHLIGHT ASSEMBLY

[76] Inventor: Tien-Tsai Huang, No. 4, Lane 30, Wu Chuan Street, Panchiao City, Taiwan

[21] Appl. No.: 895,456

[22] Filed: Aug. 11, 1986

[51] Int. Cl.[4] ..... F21L 7/00; F21V 9/16; F21I 7/00

[52] U.S. Cl. ..... 362/190; 362/202

[58] Field of Search ..... 362/190, 202, 205, 118, 362/203, 191, 249, 251, 368, 370, 382, 394, 457, 458, 295, 375

[56] References Cited

U.S. PATENT DOCUMENTS

| | | | |
|---|---|---|---|
| 1,403,707 | 1/1922 | Quarnstrom | 362/202 |
| 2,540,683 | 2/1951 | MacLean | 362/202 |
| 2,550,233 | 4/1951 | Duncan | 362/205 |
| 2,687,508 | 8/1954 | Noyes | 362/205 |
| 2,816,215 | 12/1957 | Jarred | 362/203 |
| 3,885,148 | 5/1975 | Benedetto | 362/205 |
| 4,225,907 | 9/1980 | Erdell | 362/118 |
| 4,286,311 | 8/1981 | Maglica | 362/202 |
| 4,333,129 | 6/1982 | Ewing | 362/205 |
| 4,546,416 | 10/1985 | Pemberton | 362/202 |
| 4,577,263 | 3/1986 | Maglica | 362/205 |
| 4,658,336 | 4/1987 | Maglica | 362/203 |

*Primary Examiner*—Raymond A. Nelli

*Attorney, Agent, or Firm*—Saidman, Sterne, Kessler & Goldstein

[57] ABSTRACT

An automatically-lighting flashlight assembly includes a flashlight and a holder. The flashlight includes a housing receiving an upper and a lower batteries in series connection and a light bulb arrangement, and two springs which bias the batteries normally to light the light bulb. The housing further includes a through hole at a location where the cathode of the upper battery meets the anode of the lower battery. The holder, which is coated with phosphorescent material and which is mountable, includes means for gripping the flashlight against the holder, and a separating rod which can extend into the through hole in the housing and between the batteries, breaking the electrical connection and extinguishing the light bulb. By this arrangement, the flashlight lights automatically when removed from the holder and is extinguished automatically when replaced in the holder.

11 Claims, 1 Drawing Sheet

AUTO-LIGHTING FLASHLIGHT ASSEMBLY

BACKGROUND OF THE INVENTION

This invention relates to a flashlight assembly, especially to a flashlight assembly with an automatically lighting flashlight and a holder for the flashlight which automatically switches the flashlight off when the flashlight is placed in the holder. Current flashlights have been designed with many clever features to broaden their range of uses, but there remains a defect common to prior art flashlights: they can not compensate for the carelessness of their users, who often leave them on after finishing using them, wasting the batteries and the bulb. It is also a common defect of prior art flashlights, especially of inexpensive ones, that when the flashlights are put in a drawer, a car trunk or a backpack, and jumbled around with other objects, the switch of the flashlight may turn on undesirably. Also, in an emergency, a user unfamiliar with a prior art flashlight must search for the flashlight and fumble with the switch, wasting critical time.

SUMMARY OF THE INVENTION

The object of the present invention is to overcome the disadvantages inherent in the prior art, that is, the possibility of the flashlight being lit undesirably and/or not being able to be found and turned on when needed. Another object of the invention is to provide a flashlight with a mountable holder which would allow the flashlight to be found and turned on in a hurry. To achieve these and other objects, a convenient flashlight assembly is provided which includes an automatically lighting flashlight, a mountable holder which can automatically turn off the flashlight, and a minimum of two batteries, an upper battery and a lower battery, in series connection.

The flashlight has a hollow cylindrical metal housing including a chamber receiving the upper and the lower batteries, the housing having an enlarged upper end with an inner annular shoulder and a closed lower end, and further having a through hole at an intermediate portion thereof at a location where a cathode of the upper battery contacts an anode of the lower battery; a bulb seat member fixed on the annular shoulder in the housing; a light bulb received in the bulb seat member to emit light from the flared end, the light bulb being in electrical contact with an anode of the upper battery and a cathode of the lower battery; two spring members, a first spring member being wound around the base of the light bulb, including two first ends abutting respectively the bulb seat member and the anode of the upper battery, and a second spring member including two second ends abutting respectively the closed lower end and the cathode of the lower battery, so that the first and second springs cooperatively bias the batteries to abut each other to complete, normally, the electrical connection to light the bulb.

The holder is longitudinal and includes a long body; a flat base protruding from the long body for recieving the closed end to rest on the flat base; a pair of gripping arms extending from the body for receiving the enlarged end to be removably squeezed into and held between the arms; and a non-conductive separating rod, projecting from the long body between the flat base and the gripping arms in a location corresponding to the through hole of the housing when the housing is received in the holder. When the flashlight is placed in the holder, the separating rod is capable of projecting into the through hole and extending between the batteries, breaking the electrical contact of said batteries and causing the light bulb light to be extinguished.

In one aspect of the invention, the flashlight further includes a magnifying lens pivoted near the enlarged end, so that a user may use the light from the flashlight body and the magnifying lens to find small objects conveniently. In another aspect of the invention, the holder is coated with phosphorescent material, rendering the assembly even easier to find in the dark.

The flashlight assembly of this invention is convenient because the user can mount it as desired and rest assured that as long as he places the flashlight back in the holder, the flashlight will stay off and the batteries and bulb will be saved. Even if the user chooses not to mount the flashlight, but rather to carry it around in its holder, the grip of the gripping arms will prevent the flashlight from leaving the holder and lighting. Moreover, the combination of features of the phosphorescent holder and the automatic lighting of the flashlight mean that the flashlight can be found and put to use very rapidly in an emergency.

A presently preferred embodiment of the invention will be described below with reference to the appended drawings, in which:

DRAWINGS

FIG. 1 is a perspective view of a flashlight assembly of this invention; and FIG. 2 is a cross-sectional view of the flashlight assembly of this invention showing the separating rod of the holder maintaining the flashlight in a switched-off condition.

DETAILED DESCRIPTION OF THE INVENTION

The following is a detailed description of a presently preferred embodiment of this invention. This description is meant to be illustrative of the invention, and not in any way limiting.

Figure 1:
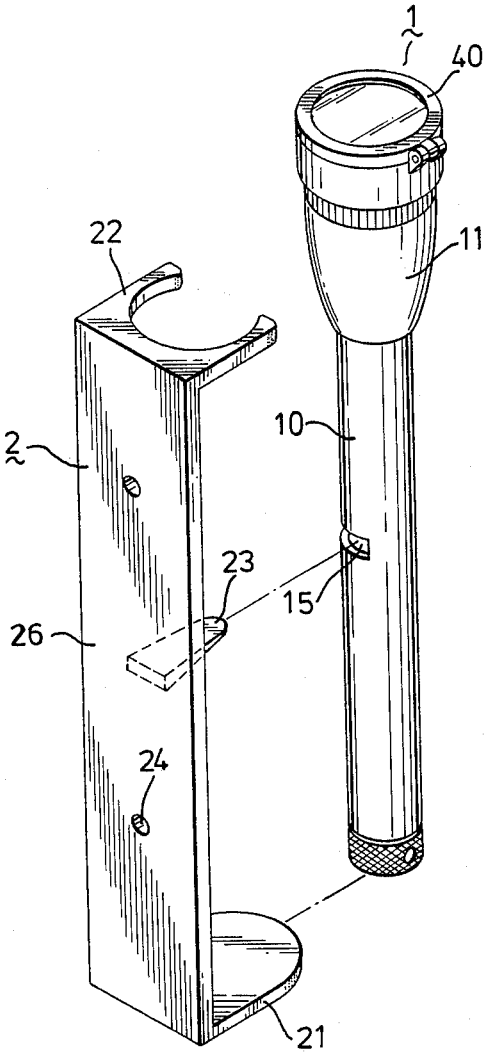
Figure 2:
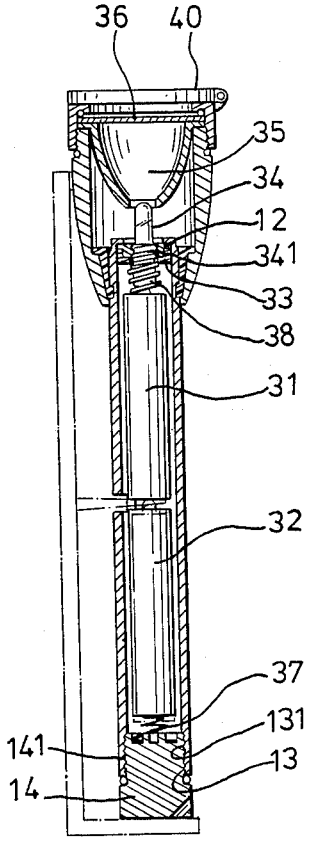

Referring to FIGS. 1 and 2, the flashlight assembly of this invention includes a flashlight 1, holder 2, and two batteries, an upper battery 31 and a lower battery 32, in series connection.

The flashlight 1 has a hollow cylindrical metal housing 10 with an upper opening 12 and a lower opening 13 and which is adapted to receive upper and lower batteries 31,32. The housing 10 further includes a through hole 15 at an intermediate portion thereof at a location where a cathode of the upper battery 31 contacts an anode of the lower battery 32 due to an arrangement which will be described below. A metal closing piece 14 with an exterior thread 141 is screwed into an inner thread 131 of the lower opening 13, closing the housing 10. Between the closing piece 14 and the cathode of the lower battery 32 is disposed a first metal helical spring 37 which biases the lower battery 32 upwardly in the housing from the closing piece 14. The batteries 31,32 may be changed by unscrewing the closing piece 14 from the lower opening 13 of the housing 10.

The flashlight 1 further includes a flared head sleeve 11, fixed at a converging portion thereof around an upper portion of said housing near said upper opening 12 and adapted to receive a light bulb 34 and a light reflecting bowl 35, with a removable transparent glass 36 screwed on around a diverging portion of the head sleeve 11 and covering the upper opening of the head sleeve 11. The light reflecting bowl 35 is hemispherical, with a light reflecting inner surface and a hole at a base thereof to receive the light bulb 34; the construction and disposition of the glass 36, and light reflecting bowl 35 in the head sleeve 11 are conventional and further description thereof will be omitted for the sake of brevity. The light bulb 34 may be accessed to be changed by removing the lens 36.

The light bulb 34 received in the head sleeve 11 and protruding into the light reflecting bowl 35 has a screw base 341 in electrical contact with the batteries 31,32. The screw base 341 of the light bulb 34 is received threadedly through a conductive bulb seat 33 fixed at the periphery of the upper opening 12 of the housing 10 so that the screw base 341 contacts the anode of the upper battery 31. The screw base 341 of the light bulb 34 is connected electrically to the cathode of the lower battery 32 through the first spring 37, the closing piece 14, the housing 10 and the bulb seat 33 in which the screw base 341 is screwed.

Around the screw base 341 of the light bulb 34 winds a second helical metal spring 38. The second spring 38 abuts the bulb seat 33 and the anode of the upper battery 31, biasing in cooperation with the first spring 37 the batteries 31,32 to contact each other and screw base 341.

Through the biasing action of the springs 37,38, and the metal components of the flashlight 1, the light bulb 34 of the flashlight 1 is normally in a lit condition. The flashlight 1 of the preferred embdodiment further includes a magnifying lens 40 pivoted near the glass 36 on the head sleeve 11.

The assembly of the preferred embodiment also comprises a a longitudinal holder 2, with a long body 26, a flat base 21 protruding from the long body 26 for receiving the closing metal piece 14 to rest thereon; a pair of gripping arms 22 extending from the body 26 for recieving the head sleeve 11 to be removably squeezed into and held between the arms 22, and a non-conductive separating rod 23, projecting from the long body 26 between the flat base 21 and the gripping arms 22 in a location corresponding to the through hole 15 of the housing 10 when the housing 10 is received in the holder 2.

The separating rod 23 is of a diameter and a length as to be receivable in the through hole 15 and extend into the housing 10 to an extent that when the flashlight 1 is placed in the holder 2, the separating rod 23 projects into the through hole 15 and between the batteries 31,32, breaking the electrical contact of the batteries 31,32 and causing the light bulb light to be extinguished. The holder 2 of the presently preferred embodiment is coated with phosphorescent material and further includes mounting holes 24 in the long body 26 and mounting screws 25 so that the flashlight assembly may be mounted in a convenient place and easily found in the dark.

When the flashlight 1 is removed from the holder 2, it lights up immediately due to the electrical connection being reestablished between the batteries 31,32 by the biasing pressure of the springs 37,38. Thus, the flashlight can be found and activated very rapidly in an emergency. When the flashlight 1 is no longer to be used, upon being snapped back into the holder 2, the flashlight 1 is automatically switched off, and stays switched off through the action of the separating rod 23.

While this invention has been illustrated by means of a preferred embodiment, it is to be understood that modifications and equivalent arrangements may suggest themselves to one skilled in the art, and that this invention is meant to include such modifications and equivalent arrangements as fall within the scope and spirit of the appended claims.

I claim:

1. An automatically-lighting flashlight assembly including: an upper battery and a lower battery;

a flashlight, having a hollow cylindrical metal housing including a chamber receiving said upper and said lower batteries, said housing having an enlarged upper end with an inner annular shoulder and a closed lower end, and further having a through hole at an intermediate portion thereof at a location where a cathode of said upper battery contacts an anode of said lower battery;

a bulb seat member fixed on said annular shoulder in said housing;

a light bulb received in said bulb seat member to emit light from said enlarged end, said light bulb being in electrical contact with an anode of said upper battery and a cathode of said lower battery;

two spring members, a first spring member being wound around said base of said light bulb, including two first ends abutting respectively said bulb seat member and said anode of said upper battery, and a second spring member including two second ends abutting respectively said closed lower end and said cathode of said lower battery, so that said first and second springs cooperatively bias said batteries to abut each other to complete, normally, the electrical connection to light said light bulb; and a longitudinal holder, including a long body, a flat base protruding from said long body for receiving said closed end to rest on said flat base, a pair of gripping arms extending from said body for receiving said enlarged end to be removably squeezed into and held between said arms, and a non-conductive separating rod, projecting from said long body between said flat base and said gripping arms in a location corresponding to the through hole of said housing when said housing is recieved in said holder;

wherein, when said flashlight body is placed in said holder, said separating rod is capable of projecting into said through hole and extending between said batteries, breaking the electrical contact of said batteries and causing the light bulb light to be extinguished.

2. A flashlight assembly as claimed in claim 1, further including a magnifying lens pivoted near said enlarged end, so that a user may use the light from the flashlight body and the magnifying lens to find small objects conveniently.

3. A flashlight assembly as claimed in claim 1, wherein said holder is coated with phosphorescent material.

4. A flashlight assembly as claimed in claim 1, further including a mounting hole and a mounting screw disposed in said long body for mounting said holder.

5. A flashlight assembly comprising:

a flashlight, including a bulb, batteries spring-loaded to abut, and an electrical circuit connected such that when said flashlight is freestanding, said batteries abut to close said circuit and light said bulb;

a holder, shaped to fit together with said flashlight, said holder comprising a protrusion;

said flashlight and said holder being shaped to fit together in such fashion that said protrusion of said holder is received within said flashlight to separate said abutting batteries and thereby interrupt said electrical circuit within said flashlight.

6. A flashlight assembly comprising:

a flashlight, said flashlight including therein space for one or more batteries and a bulb, and an electrical circuit connecting the batteries with the bulb;

a holder shaped to fit together with said flashlight;

said holder comprising a protrusion such that, when said holder and said flashlight are fitted together, said protrusion can be received within the body of said flashlight in a relation such that said protrusion breaks said electrical circuit within said flashlight between the bulb and the batteries;

whereby when said flashlight is at rest in said holder, said flashlight is not shining, but when said flashlight is manually removed from said holder, said flashlight immediately begins to shine, without any other manual activation by the user.

7. The flashlight assembly of claim 5, wherein said battery chamber receives exactly two of said batteries.

8. The flashlight assembly of claim 6, wherein said flashlight includes space for exactly two batteries.

9. The flashlight assembly of claim 6, wherein said flashlight includes space for a plurality of batteries.

10. The flashlight assembly of claim 5, wherein said flashlight includes no switching mechanism apart from cooperation with said holder.

11. The flashlight assembly of claim 6, wherein said flashlight includes no switching mechanism apart from cooperation with said holder.

* * * * *